US005763989A

United States Patent [19]

Kaufman

[11] Patent Number: 5,763,989

[45] Date of Patent: Jun. 9, 1998

[54] CLOSED DRIFT ION SOURCE WITH IMPROVED MAGNETIC FIELD

[75] Inventor: Harold R. Kaufman, LaPorte, Colo.

[73] Assignee: Front Range Fakel, Inc., Ft. Collins, Colo.

[21] Appl. No.: 740,026

[22] Filed: Oct. 23, 1996

Related U.S. Application Data

[63] Continuation-in-part of Ser. No. 405,165, Mar. 16, 1995, abandoned.

[51] Int. Cl.[6] ..... H05H 1/02

[52] U.S. Cl. ..... 313/361.1; 313/362.1; 315/111.91; 315/111.41

[58] Field of Search ..... 313/359.1, 360.1, 313/361.1, 362.1, 231.31, 618, 631; 315/111.91, 111.41

[56] References Cited

U.S. PATENT DOCUMENTS

| | | | |
|---|---|---|---|
| 3,831,052 | 8/1974 | Knechtli | 313/359.1 |
| 4,862,032 | 8/1989 | Kaufman | 313/359.1 |
| 5,218,271 | 6/1993 | Egorov | 315/111.61 |
| 5,359,258 | 10/1994 | Arkhipov | 313/359.1 |
| 5,646,476 | 7/1997 | Aston | 313/359.1 |

*Primary Examiner*—Sandra L. O'Shea
*Assistant Examiner*—Michael Day
*Attorney, Agent, or Firm*—Hugh Drake; Dean P. Edmundson

[57] ABSTRACT

Closed-drift ion sources of the magnetic-layer and anode-layer types are shown and described, with both one-stage and two stage versions of the latter included. Specific improvements include the use of a magnetically permeable insert in the closed drift region together with an effectively single source of magnetic field to facilitate the generation of a well-defined and localized magnetic field while, at the same time, permitting the placement of that magnetic field source at a location well removed from the hot discharge region. Such a configuration is also well suited to the use of a permanent magnet as the magnetic field source. In one embodiment a baffle arrangement serves to distribute the ionizable gas uniformly circumferentially and decrease its pressure below the Paschen-law minimum before exposure to the anode potential.

10 Claims, 3 Drawing Sheets

CLOSED DRIFT ION SOURCE WITH IMPROVED MAGNETIC FIELD

CROSS-REFERENCE TO RELATED APPLICATION

This application is a continuation-in-part of my application Ser. No. 08/405,165, filed Mar. 16, 1995, now abandoned.

FIELD OF INVENTION

This invention relates generally to ion and plasma technology, and more particularly it pertains to plasma and ion accelerators with closed electron drift.

The invention can find application in industrial applications such as sputter etching, sputter deposition, coating and property enhancement. It can also find application in electric space propulsion.

BACKGROUND ART

The acceleration of ions to form energetic beams of ions has been accomplished both electrostatically and electromagnetically. When such ion beams are dense enough to be useful in either space propulsion or industrial processes, they are also dense enough to require the presence of electrons within the beam to offset the space charge of the ions. Because both ions and electrons are present, the ion beams can also be referred to as plasma beams and the ion source can also be referred to as a plasma source.

The technology of electrostatic ion sources is described by Kaufman et al. in *AIAA Journal*, Vol. 20, No. 6, beginning on page 745, incorporated herein by reference. This reference is primarily directed at industrial ion sources, but the technology is generally similar for thrusters used in electric space propulsion. The main differences have to do with the increased lifetimes required without maintenance in thrusters. The ion current density of electrostatic ion sources is limited by the electrostatic acceleration process, in which the ions are accelerated in a region free of electrons, usually the region between two closely spaced grids.

In ion sources (or thrusters) with electromagnetic acceleration, there is a discharge between an electron-emitting cathode and an anode. The accelerating electric field is established by the interaction of the electron current in this discharge with a magnetic field created between the anode and cathode, and the acceleration of ions takes place within a neutral plasma (both ions and electrons present). Because of the presence of electrons, the electromagnetic acceleration process has no space-charge limit similar to that in electrostatic acceleration. An electromagnetic ion source can use a single aperture, or acceleration channel, and a generally axial magnetic field configuration as shown in U.S. Pat. No. 4,862,032 - Kaufman et al, incorporated herein by reference.

Electromagnetic ion sources of the closed-drift type usually use acceleration channels that are annular in shape although more complicated shapes are also used. In all cases, the acceleration channel in a closed-drift ion source is in the shape of a closed path, and the "closed drift" in the name refers to the motion of electrons in following this closed path. The electron drift direction is normal to the magnetic field which is radial in the usual axisymmetric configuration having an annular opening. Because the closed-drift of electrons is normal to both the magnetic field and the electric field, the electron drift also constitutes a "Hall current." The technology of closed-drift thrusters (or ion sources) is described by Kaufman in *AIAA Journal*, Vol. 23, No. 1, beginning on page 78, incorporated herein by reference.

As described in the above cited reference, closed-drift ion sources are of two general types. One type uses a dielectric wall for the acceleration channel and is variously referred to as an accelerator with closed-drift and extended acceleration, a magnetic-layer accelerator and a stationary plasma thruster. An example of this type of closed-drift ion source is described in U.S. Pat. No. 5,359,258 - Arkhipov, et al. Because this dielectric wall must withstand high operating temperatures, it is typically constructed of a refractory ceramic.

The other type of closed-drift ion source uses conducting walls, usually of metal. It generally has a shorter acceleration channel and is called an anode-layer ion source or thruster.

The difference between the two types of closed-drift ion sources results from the interaction, or lack thereof, of electrons with a dielectric wall. When a dielectric wall is present, energetic electrons from the discharge plasma collide with the wall and release low-energy secondary electrons. In this manner, the electron temperature in the plasma is maintained at a moderate level and the acceleration process can take place over an extended length. Without a dielectric wall, the electrons gain energy in passing from the electron-emitting cathode to the anode, reaching a random energy (temperature) high enough that the potential distribution is affected. A substantial portion of the potential difference occurs in a short acceleration distance of the order of one electron orbit in the local magnetic field. This short distance is located near an anode potential electrode, hence the name "anode layer." The differences in magnetic-layer and anode-layer acceleration processes are described further by Kaufman in *Journal of Spacecraft and Rockets*, Vol. 21, No. 6, starting on page 558, incorporated herein by reference.

Although there are differences in the prior art acceleration processes in magnetic-layer and anode-layer ion sources, both ion sources require a well-defined region of high-strength magnetic field for efficient and reliable operation. More specifically, the magnetic field strength should be highest near the region where the ions receive most of their acceleration, and be much lower on both sides of this high-strength region. This magnetic field shape is achieved by the use of a magnetic circuit consisting of a source or sources of magnetic field, two pole pieces and a permeable path to connect the pole pieces and the source or sources of magnetic field. The desired magnetic field is generated in the gap between the two pole pieces. The pole pieces are on both the inside and outside of the acceleration channel and have the same general shape as the inner and outer walls of the acceleration channel. In some cases, the pole pieces constitute the walls of the acceleration channel.

Achieving a magnetic field shape where most of the magnetic flux is confined within a well-defined and localized region, as described above, has been a major objective in the design of closed-drift ion sources. Such a magnetic field configuration is an objective of the aforementioned U.S. Pat. No. 5,359,258 - Arkhipov, et al. The approach in that patent uses a permeable insert, either separate from or integral with the magnetic circuit. In addition to this permeable insert, the approach of Arkhipov, et al., requires both inner and outer magnetic field sources in order to generate a substantially radial magnetic field direction between the inner and outer pole pieces. It is known to those skilled in the art that the desired magnetic field direction requires the adjustment of the relative strengths of inner and outer magnetic field sources (i.e., the relative adjustment of the currents to the inner and outer electromagnets). The approach of Arkhipov, et al., thus has the shortcoming of requiring an inner magnetic field source, which can be damaged by excessive temperature, in a location that is restricted in volume and close to the heat generating discharge region. It should also be noted that the statement of Arkhipov, et al., "at least one internal and at least one external source of magnetic field" permits several internal sources to operate in parallel and serve effectively as one internal source, or several external sources to operate in parallel and serve effectively as one external source. In any event, Arkhipov, et al., require the use of both an internal source and an external source of magnetic field.

Both the magnetic-layer and anode-layer ion sources also introduce an ionizable gas into the anode at a pressure that is high compared to the operating pressure within the discharge and accelerating region. This prior art means of gas introduction has two results.

First, the connection of the gas feed line to the anode results in the need for a voltage isolator in the feed line. Because of the need for startup and operation over a range of gas flows, it is typical to design for the worst case, which is the minimum breakdown voltage, typically found at a pressure-length product of 1–10 Torr-cm (the Paschen-law minimum). As described by A. Von Engel, *Ionized Gases*, Table 7.4, page 196 (1965), incorporated herein by reference, the minimum breakdown voltages for most gases are more than 200 V. Helium is an exception at 150 V, but it is seldom used in either industrial ion sources or electric propulsion thrusters. The design procedure for isolators that must operate at voltages higher than about 200 V, then, is to use a layered construction where each layer withstands 200 V, or less, and multiple layers are used to withstand the desired total voltage. The construction of such an isolator can be complicated and expensive.

Second, because of the relatively high pressure at the anode, the regions near the anode apertures through which the ionizable gas is released can become localized concentrations of discharge, with said concentrations resulting in both localized thermal damage to the anode and departures from the circumferential uniformity required for efficient operation of a closed-drift ion source or thruster.

SUMMARY OF INVENTION

In light of the foregoing, it is an overall general object of the invention to provide an improved magnetic field configuration for closed-drift ion sources and thrusters of both the magnetic-layer and anode-layer types.

A more specific object of the present invention is to optimize the shape of the magnetic field while yet enabling the use of what is at least effectively a single source of that field.

Another object of the present invention is to facilitate the use of permanent magnets for producing the magnetic field.

It is a further overall general object of the invention to provide for the introduction of the ionizable gas to the vicinity of the anode at a pressure near that required for operation, thereby avoiding both the need for voltage isolation in the gas feed line and the possibility of arcing near the anode.

In accordance with one specific embodiment of the present invention, a closed-drift ion source takes a form that includes means for introducing a gas, ionizable to produce a plasma, into a generally annular region within the source. An anode is located at one side of this region and an electron-emitting cathode is located at the other side. The electron current in the discharge between the anode and the cathode interacts with a magnetic field in the same region to generate a closed drift of electrons around the generally annular region and an electric field to accelerate ions in the general direction from the anode to the cathode. The magnetic field is generated by a single source of magnetic field, or a plurality of such sources acting in parallel and therefore acting effectively as a "single" magnetic field source. Thus, for the purposes of this invention, the term "single magnetic field producing means" is meant to refer to either a single source of magnetic field or a plurality of such sources acting in parallel with each other. Other elements of the magnetic circuit form a permeable path between this magnetic field source and magnetic pole pieces between which the magnetic field is established. A desirable magnetic field shape is achieved by the use of an additional magnetically-permeable insert, physically separate from other elements of the magnetic circuit and located on the anode side of the generally annular region. Said permeable insert serves to decrease the strength of the magnetic field at the anode side of the generally annular region, thereby facilitating the generation of the well-defined and localized magnetic field required for efficient and reliable operation of a closed-drift ion source. Because of the use of a single source of magnetic field, this magnetically-permeable insert must be physically separate from the other elements of the magnetic circuit to obtain an substantially radial direction of the magnetic field between the pole pieces. In contrast, if the insert were attached to magnetic-circuit elements on either side of the single magnetic field source, the direction of the magnetic field between the pole pieces would be deflected too far in one direction or the other.

While closed-drift ion sources can operate without the use of a permeable insert, the use of this insert permits correction for the adverse proximity effects of magnetic-circuit elements. These effects can be severe in compact ion-source configurations. For a given overall ion-source size, such adverse effects tend to be most severe for configurations in which the sources of magnetic field are farthest from the discharge region as would otherwise be advantageous to minimize adverse heating effects on the sources of magnetic field. As described above, the use of a separate magnetically-permeable insert is necessary when a single source of magnetic field is used, or several magnetic field sources used in parallel so that they constitute an effectively single source of magnetic field.

DESCRIPTION OF FIGURES

Features of the present invention which are believed to be patentable are set forth with particularity in the appended claims. The organization and manner of operation of the invention, together with further objectives and advantages thereof, may be understood by reference to the following descriptions of specific embodiments thereof taken in connection with the accompanying drawings, in the several figures of which like reference numerals identify like elements and in which:

It may be noted that the aforesaid schematic views represent the surfaces in the plane of the section while avoiding the clutter which would result were there also a showing of the background edges and surfaces of the overall generally-cylindrical-assemblies.

DESCRIPTION OF PRIOR ART

Figure 1:
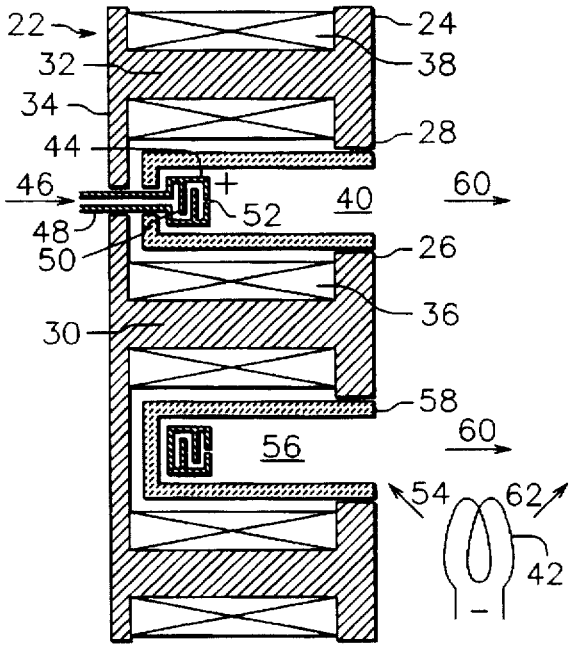
Fig. 1 (PRIOR ART)
FIG. 1 is a schematic cross-sectional view of a prior-art closed-drift ion source of the magnetic-layer type.

Referring now to FIG. 1, there is shown an approximately axisymmetric closed-drift ion source of the prior art, more particularly one of the magnetic-layer type. Ion source 22 includes a generally-cylindrical magnetic-circuit assembly 24, which is comprised of magnetically permeable inner pole piece 26, magnetically permeable outer pole piece 28, magnetically permeable inner path 30, one or more magnetically permeable outer paths 32, magnetically permeable back plate 34, inner magnetically energizing coil 36, one or more outer magnetically energizing coils 38, all of which serve, when energized by appropriate sources of electrical power, to generate a magnetic field in region 40 between the inner and outer pole pieces. Cathode 42 is connected to the negative terminal of a typical electrical power supply (not shown), while anode 44 is connected to the positive terminal. Ionizable gas 46 enters anode 44 through flow-passage 48. Because the flow passage is attached to the anode and the external source of ionizable gas is normally at ground potential, a voltage-isolation means is installed between flow-passage 48 and the external source of ionizable gas. A typical voltage isolator is shown in S. Nakanishi, *NASA Technical Memorandum* TM X-1579, May 1968, FIG. 7, page 21, incorporated herein by reference. Ground is the spacecraft potential for a thruster on a spacecraft and the potential of the surrounding vacuum chamber for an industrial ion source.

The ionizable gas is uniformly distributed around the circumference within anode 44 by baffle arrangement 50, and leaves through one or more apertures 52. Aperture 52 may be a single circumferential slit or a plurality of circumferentially distributed circular apertures.

An electron flow 54 from cathode 42 to anode 44 serves to ionize the gas molecules leaving anode 44 through apertures 52, thereby generating a plasma (a gaseous mixture of electrons and ions) in channel 56 enclosed by dielectric wall 58. The electron flow also interacts with the magnetic field in region 40 to establish an accelerating electric field (not shown) within region 40. The ions that do not recombine with electrons on surfaces of anode 44 and dielectric wall 58 are accelerated outward by the electric field to form energetic ion beam 60. Portion 62 of the electron emission that leaves cathode 42 serves to charge and, if necessary, to current neutralize ion beam 60.

A normal procedure in the initial operation of an ion source of the type shown in FIG. 1 is to optimize the current ratio between the inner magnetically energizing coil 36 and the one or more outer magnetically energizing coils 38. This optimization is required to establish a nearly radial field direction in region 40. The strength of the magnetic field will depend on the desired operating voltage, being higher for a higher anode-cathode voltage difference.

Those skilled in the art will recognize that a number of refinements can be made in the design indicated in FIG. 1. As one example, cathode 42 in FIG. 1 is indicated schematically to be an electrically heated, thermionically emitting cathode. While this type of electron-emitting cathode is satisfactory for many applications, other applications may require other types of cathodes, such as a hollow cathode in which the electrons are emitted internally of the cathode and a plasma stream, generated from an internal flow of gas, serves to conduct the electrons to the primary plasma consisting of ion beam 60 and accompanying electrons 62. An example of a hollow cathode is described in U.S. Pat. No. 359,254 - Arkhipov et al. The plasma-bridge cathode, which incorporates features of both a thermionically emitting cathode and a hollow cathode, is yet another type of cathode that could be used.

As another example of a refinement, the gas leaving apertures 52 produces locally high values of pressure. These high pressure regions can result in a concentration of electrical discharge to the anode near one or more of these apertures, and the electrical discharge concentrations can, in turn, result in both local thermal damage to the anode and a departure from circumferential uniformity for the electrical discharge that can reduce the operating efficiency of a closed-drift ion source. The elimination of such localized and anode-damaging discharges is an objective of U.S. Pat. No. 5,218,271 - Egorov, et al.

As yet another example of a refinement, it is recognized by one even moderately skilled in the art that the accelerating electric field for the ions will tend to be concentrated in region 40 where the strength of the magnetic field is greatest. But as described by Bugrova, et al. in *AIDAA/AIAA/DGLR/JSASS 22nd International Electric Propulsion Conference,* Paper No. IEPC-91-079, October 1991, one more skilled in the art will recognize (1) that plasma stability effects of changes in magnetic field strength will result in a further concentration of the accelerating electric field in that portion of region 40 where the strength of the magnetic field increases in the direction of ion motion and (2) that very little of the accelerating electric field will be found in that portion of region 40 where the strength of the magnetic field decreases in the direction of ion motion (to the right of the location of maximum magnetic field strength in FIG. 1.). This means that the magnetic field to the left of the location of maximum magnetic field strength in region 40 is most important for efficient operation of a closed-drift ion source. As mentioned in the introduction, control of the distribution of the field in that location is an objective of U.S. Pat. No. 5,359,258 -Arkhipov et al.

But there are also some shortcomings of the prior art. Inner and outer electromagnets (36 and 38 in FIG. 1) are a common design feature in closed-drift ion sources. These electromagnets generate heat due to resistive losses associated with their energizing electrical currents, and the heat can cause temperature rises that damage the electromagnets. Because portions of these electromagnets are close to the region of maximum magnetic field strength between pole pieces 26 and 28, where most of the discharge energy between the anode and cathode is dissipated, they are also subject to additional heating from this discharge. The electromagnet heating problem is aggravated by the fact that, in the vacuum environment in which these ion sources operate, there is almost no heat conduction across bolted or other contact joints.

While a water-cooled electromagnet is possible in an industrial application, water lines may be sources of leaks and therefore are undesirable in the vacuum chambers in which ion sources are used. In the absence of water cooling, the multiple turns of conductor, with insulation between turns and layers of turns, constitutes a substantial source of outgassing, which is also undesirable in an industrial application. It is often necessary for an industrial ion source to operate within five or ten minutes after the vacuum chamber reaches operating pressure. The outgassing rate of electromagnets that are not water cooled would be too high to permit rapid operation after a quick pumpdown.

Figure 2:
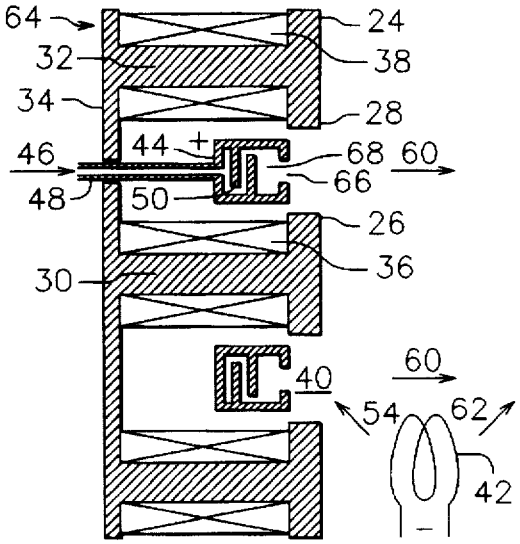
Fig. 2 (PRIOR ART)
FIG. 2 is a schematic cross-sectional view of a prior-art closed-drift ion source of the single-stage anode-layer type.

FIG. 2 represents another approximately axisymmetric closed-drift ion source of the prior art, more particularly one of the single-stage anode-layer type. Ion source 64 again includes magnetic-circuit assembly 24, which is comprised of magnetically permeable inner pole piece 26, magnetically permeable outer pole piece 28, magnetically permeable inner path 30, one or more magnetically permeable outer paths 32, magnetically permeable back plate 34, inner magnetically energizing coil 36, one or more outer magnetically energizing coils 38, all of which serve, again when energized by appropriate sources of electrical power, to generate a magnetic field in region 40 between the inner and outer pole pieces. The negative terminal of an electrical power supply (not shown) is again connected to electron-emitting cathode 42 and the positive terminal to anode 44. Ionizable gas 46 enters anode 44 through flow-passage 48, is uniformly distributed around the circumference within the anode by baffle arrangement 50 and leaves through annular aperture 66 from region 68 adjacent to aperture 66 and enclosed by anode 44. Electron flow 54 from cathode 42 to anode 44 again serves to ionize the gas molecules leaving anode 44 through aperture 66, thereby generating a plasma (a gaseous mixture of electrons and ions) in region 68, aperture 66, and region 40. Electron flow 54 also interacts with the magnetic field in region 40 to establish an accelerating electric field (not shown) within said region. The ions that do not recombine with electrons on surfaces of anode 44 and magnetic poles 26 and 28 are accelerated outward by said electric field to form energetic ion beam 60. Portion 62 of the electron emission that leaves cathode 42 serves to charge and, if necessary, to current neutralize ion beam 60.

In comparing the operation of the configuration shown in FIG. 2 with that in FIG. 1, although the discharge in normal operation enters volume 68 enclosed by the anode, the overall region of ion generation and acceleration in FIG. 2 (region 68, aperture 66 and region 40) is relatively shorter than the overall region of ion generation and acceleration in FIG. 1 (channel 56 which includes region 40). The shortcomings of the electromagnets used in FIG. 2 are similar to those discussed in connection with FIG. 1. As described in the background art section, the acceleration process also differs in that a substantial part of the accelerating potential difference in the anode-layer source of FIG. 2 is found in a thin layer near the anode 44.

Figure 3:
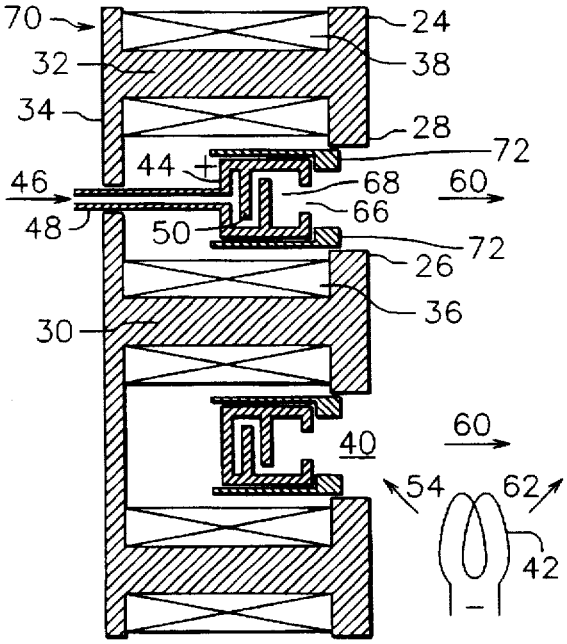
Fig. 3 (PRIOR ART)
FIG. 3 is a schematic cross-sectional view of a prior-art closed-drift ion source of the two-stage anode-layer type.

Referring now to FIG. 3, yet another approximately axisymmetric closed-drift ion source of the prior art is shown, more particularly is one of the two-stage anode-layer type. The operation of ion source 70 is generally similar to the configuration shown in FIG. 2, except for the inclusion of additional electrode 72 at a potential intermediate those of cathode 42 and anode 44. The inclusion of additional electrode 72 permits further variation of electrical parameters to optimize performance. The advantage of additional optimization for the configuration shown in FIG. 3 compared to that in FIG. 2 must, of course, be balanced against the additional complexity.

Figure 4:
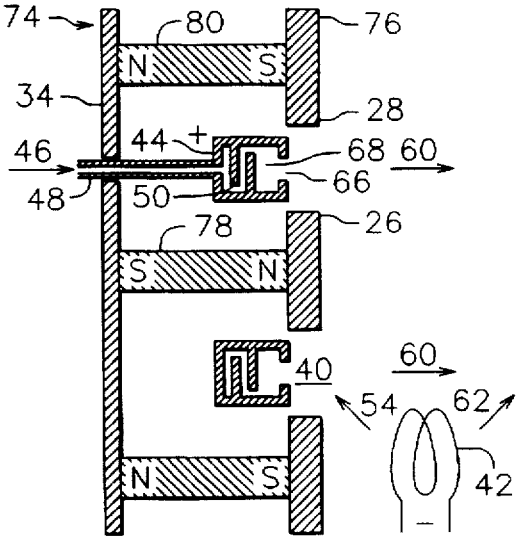
FIG. 4 is a schematic cross-sectional view of a possible closed-drift ion source of the single-stage anode-layer type in which the source of magnetic field consists of permanent magnets.

FIG. 4 shows yet another approximately axisymmetric closed-drift ion source, more particularly another one of the anode-layer type. While consistent with prior art, this ion source is a possibly hypothetical one. It is presented here for the purposes of illustrating the difficulty of using permanent magnets instead of electromagnets. Ion source 74 is generally similar to the anode-layer ion source of FIG. 2, but includes inner permanent magnet 78 (in place of inner magnetically permeable path 30 and inner magnetically energizing coil 36 shown in FIG. 2) and also includes one or more outer permanent magnets 80 (in place of the one or more outer magnetically permeable paths 32 and the one or more outer magnetically energizing coils 38 shown in FIG. 2).

Except for the use of permanent magnets in place of electrically energized coils as sources of magnetic field, the operation of the configuration shown in FIG. 4 is generally similar to that in FIG. 2. From a practical viewpoint, however, the outgassing time for the permanent magnets would be greatly reduced as compared to electromagnets. Also from a practical view-point, the optimization of the magnetic field is easier to accomplish by varying the current ratio between inner coil 36 and one or more outer coils 38 in FIG. 2, than it is by varying the relative strengths of inner permanent magnet 78 and outer permanent magnets 80 in FIG. 4. Permanent magnets also have temperature limits, and it is not clear whether the temperature problems would be less severe for the configuration of FIG. 4 than for the configuration of FIG. 2.

Figure 5:
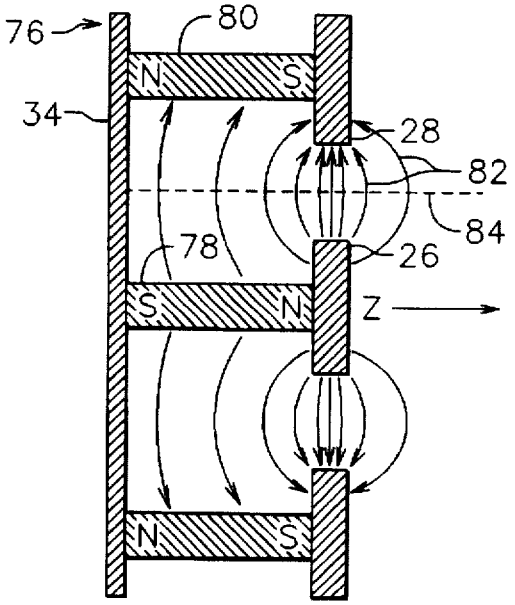
FIG. 5 is a schematic cross-sectional view of the magnetic circuit of the closed-drift ion source of FIG. 4.

FIG. 5, shows magnetic circuit 76 of the approximately axisymmetric closed-drift ion source of FIG. 4. The axis of symmetry is indicated by Z. The shape of the magnetic field is indicated by field lines 82. Mean radius 84 is frequently used to characterize the axial variation of magnetic field strength. Because the variation of magnetomotive force along a permanent magnet is similar to the variation of magnetomotive force along a magnetically energizing coil, the shape of magnetic field lines 82 in FIG. 5 is also very similar to the shape the magnetic field lines would have for the magnetic circuits of FIG. 1 through FIG. 3. From the generally radial direction of the magnetic field between inner pole piece 26 and outer pole piece 28, the relative strengths of inner and outer permanent magnets 78 and 80 are assumed to be optimized in FIG. 5.

While the configuration of FIG. 4 is readily apparent from prior art by the simple substitution of permanent magnets for electromagnets, it is not clear if such a configuration has actually been built. The reason for not building such a configuration is assumed to be the relative inflexibility of permanent magnets to adjustment of strength, particularly the adjustment required to achieve the optimum balance of inner and outer permanent magnet strengths.

Figure 6:
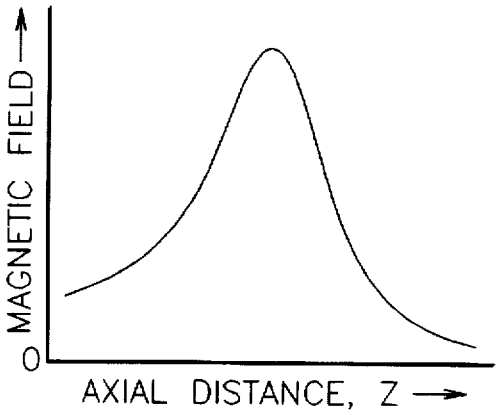
FIG. 6 depicts the axial variation of the magnetic field strength in the closed-drift ion source configuration of FIG. 5.

Referring now to FIG. 6, there is shown the variation of magnetic field strength for the configuration of FIG. 5, with axial location Z measured at mean radius 84. The maximum in field strength in FIG. 6 is located near pole pieces 26 and 28 in FIG. 5, while the variation to the left of this maximum in FIG. 6 is the variation to the left of those pole pieces in FIG. 5. The well-defined and localized region of magnetic field that is required for a closed-drift ion source is shown by the near-maximum portion of the curve in FIG. 6. The variation of magnetic field strength shown in FIG. 6 would also be very similar to the variation the magnetic field strength for the magnetic circuits of FIG. 1 through FIG. 3.

Figure 7:
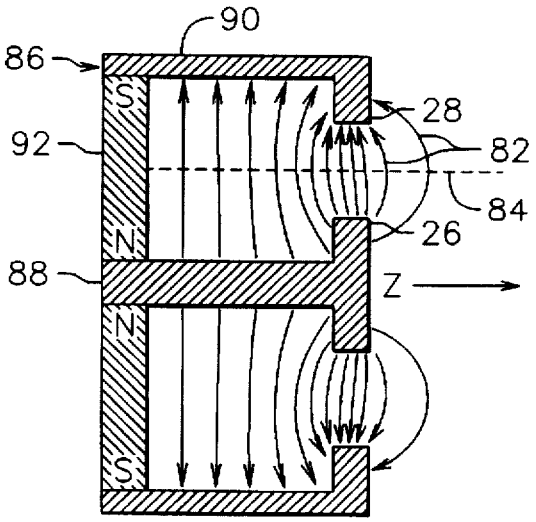
FIG. 7 is a schematic cross-sectional view of the magnetic circuit of a another possible closed-drift ion source.

FIG. 7 depicts magnetic circuit 86 of another approximately axisymmetric closed-drift ion source, also consistent with the prior art, but possibly hypothetical and also introduced here for the purposes of illustration. In addition to inner and outer pole pieces 26 and 28, the magnetic-circuit elements include inner magnetically permeable path 88, outer magnetically permeable path 90, and one or more permanent magnets 92. Note that with circumferentially uniform permeable paths 88 and 90 of sufficient thickness, moderate variations in the strength of individual ones of a plurality of permanent magnets 92 would still result in effectively one magnetic field source for that plurality of the magnets. The axis of symmetry is again indicated by Z and the shape of the magnetic field is again indicated by field lines 82.

The configuration shown in FIG. 7 is desirable from the viewpoint that effectively a single source of magnetic field is used, hence no balancing of strengths is required for the inner and outer sources of magnetic field. Because sources of magnetic field, whether permanent magnets or electrically energized coils, have maximum permissible temperatures, the magnet location shown in FIG. 7 is also desirable from the viewpoint that the source of magnetic field is located far from the region of maximum magnetic field strength between pole pieces 26 and 28, where most of the discharge energy between the anode and cathode is dissipated.

Figure 8:
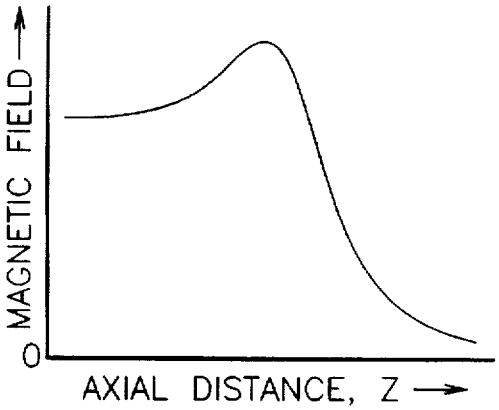
FIG. 8 depicts the axial variation of the magnetic field strength in the closed-drift ion source of FIG. 7.

Referring now to FIG. 8, there is shown the variation of magnetic field strength for the configuration of FIG. 7 with axial location Z at mean radius 84. The maximum in field strength in FIG. 8 is again located near pole pieces 26 and 28, while the variation to the left of this maximum in FIG. 8 is the variation to the left of said pole pieces in FIG. 7.

The distributions of magnetic field direction and strength shown in FIGS. 7 and 8 show significant shortcomings compared to the distributions of direction and strength shown in FIGS. 5 and 6. These shortcomings are the adverse effects referred to earlier when the magnetic field source (or sources) is located far from the discharge region in a compact closed-drift ion source. The general direction of magnetic field between pole pieces 26 and 28 in FIG. 7 departs significantly from the radial direction preferred in most applications. In addition, the region of near-maximum strength magnetic field in FIG. 8 is less well-defined and localized than in FIG. 6. Further, it is the variation of magnetic field to the left of pole pieces 26 and 28 in FIG. 7 and to the left of the maximum magnetic field strength in FIG. 8 that is most affected, in that the desirable decrease in field strength in this region that is shown in FIG. 6 is not shown in FIG. 8. From the distributions of magnetic field direction and strength shown in FIGS. 7 and 8, then, the magnetic-circuit configuration shown in FIG. 7 is not as well suited for a closed-drift ion source.

One skilled in the art of magnetic field design will observe that the departure of the magnetic field from a radial direction in FIG. 7 results from the larger longitudinal wall area associated with outer magnetically permeable path 90 than with that of inner magnetically permeable path 88. It can further be observed that this effect could be eliminated by moving the outer permeable path sufficiently far from mean radius 56. On the other hand, the general high level of magnetic field strength to the left of pole pieces 26 and 28 results from the additive effects of permeable paths 88 and 90, and this effect can be reduced by moving the permeable paths 88 and 90 farther from the mean radius, but it cannot be eliminated. The general high level of magnetic field strength is therefore a more serious problem than the departure from the radial direction.

DESCRIPTION OF THE PREFERRED EMBODIMENTS

Figure 9:
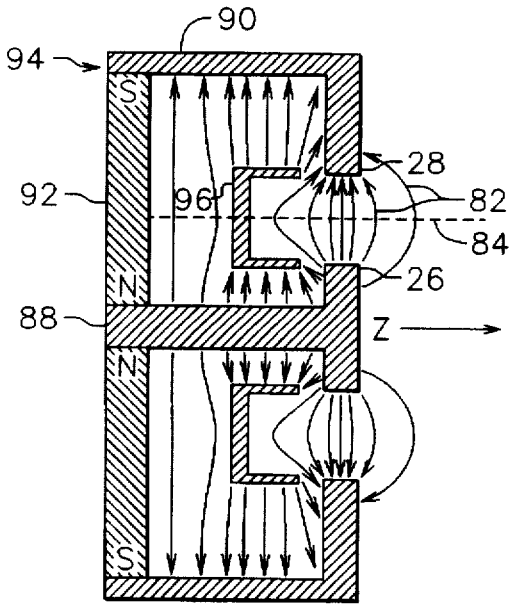
FIG. 9 is a schematic cross-sectional view of the magnetic circuit of a closed-drift ion source constructed in accordance with one specific embodiment of the present invention.

FIG. 9 sets forth magnetic circuit 94 of an approximately axisymmetric closed-drift ion source that embodies the improvements of the present invention. In addition to inner and outer pole pieces 26 and 28, the circuit elements include inner magnetically permeable path 88, outer magnetically permeable path 90 and one or more permanent magnets 92. Physically separate from those elements of the magnetic circuit is magnetically permeable insert 96. Again note that with circumferentially uniform permeable paths 88 and 90 of sufficient thickness, moderate variations in the strength of individual ones of a plurality of permanent magnets 92 would still result in effectively one magnetic field source from that plurality of magnets. The axis of symmetry is again indicated by Z and the shape of the magnetic field is again indicated by field lines 82.

Figure 10:
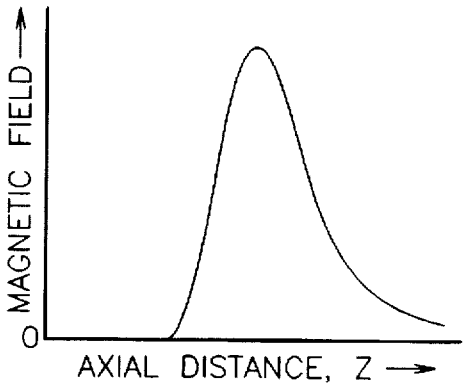
FIG. 10 depicts the axial variation of the magnetic field strength in the closed-drift ion source of FIG. 9.

FIG. 10 shows the variation of magnetic field strength with axial location Z of the magnetic circuit in FIG. 9 at mean radius 84. The maximum in field strength as shown in FIG. 10 is again located near pole pieces 26 and 28 in FIG. 9, while the variation to the left of this maximum as shown in FIG. 10 is the variation to the left of pole pieces 26 and 28 in FIG. 9.

The magnetic circuit shown in FIG. 9 is desirable from the viewpoint that effectively a single source of magnetic field is used (similar in that regard to the magnetic circuit of FIG. 7). Further, the magnet location shown in FIG. 9 is also desirable because it is located far from where most of the discharge energy between the anode and cathode is dissipated.

As can be seen from FIG. 10, the presence of permeable insert 96 in the configuration of FIG. 9 results in the magnetic field strength reaching a near-zero value at the insert. As a result, the region of near maximum magnetic field strength to the left of pole pieces 26 and 28 is much more well-defined and localized than for the circuit of FIG. 7, and it is even more well-defined and localized than for the circuit of FIG. 5.

It will be observed that the radial field direction between pole pieces 26 and 28 in FIG. 9 results from having a large radius for outer permeable path 90 relative mean radius 84, when compared with the similar radii in FIG. 7. The exact dimensions to achieve a radial field between the pole pieces are best obtained from Laplace's equation. For the configuration shown in FIG. 9, a radial field is achieved with the ratio of the inner radius of outer permeable path 90 divided by the radius of outer pole piece 28 approximately equal to the radius of inner pole piece 26 divided by the outer radius of inner permeable path 88.

It should be noted that there is an iteration to achieve a radial direction of the magnetic field between pole pieces 26 and 28 for the configuration shown in FIG 9. But this iteration is done in the design stage before fabrication or, at the very least, with a cut-and-try testing of different configurations before reaching a final design. In the more conventional magnetic-circuit design for a closed-drift source, the iteration for a radial field direction is carried out after design and fabrication by testing different ratios of currents to inner and outer magnetically energizing coils (coils 36 and 38 in FIGS. 1 through 3). The use of an effectively single magnetic source well removed from the discharge energy between the pole pieces while maintaining a radial field direction between those pole pieces is thus the result of a more thorough and comprehensive design process.

Figure 11:
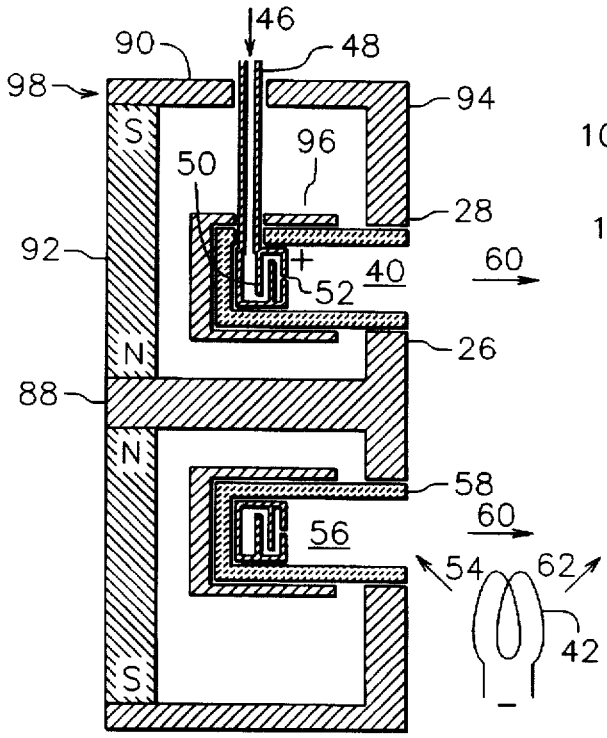
FIG. 11 is a schematic cross-sectional view of a closed-drift ion source constructed in accordance with another specific embodiment of the present invention.

FIG. 11 represents an approximately axisymmetric close-drift ion source 98 that incorporates a magnetic circuit similar to that of FIG. 9 and, therefore, is one embodiment of the present invention. Except for the use of inner and outer magnetically permeable paths 88 and 90, an effectively single magnetic field source 92 and magnetically permeable insert 96, the configuration of FIG. 11 is similar to the magnetic-layer type of closed-drift ion source shown in FIG. 1. The description of operation for FIG. 11 is also similar to that of FIG. 1.

The advantages of the configuration of FIG. 11 over that of the prior art of FIG. 1 include improved operation due to the better magnetic field shape that results from the addition of permeable insert 96, and the freedom to move the source or sources of magnetic field far from the region in which most of the discharge energy is dissipated. At the same time, with proper selection of the inner and outer radii, relative to the mean radius, an approximately radial direction is obtained for the magnetic field between inner pole piece 26 and outer pole piece 28 (region 40) while enabling the use of effectively one source of magnetic field.

Figure 12:
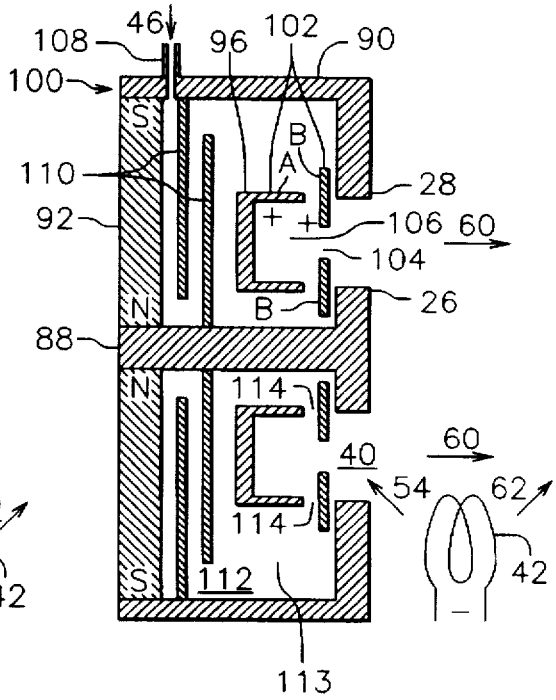
FIG. 12 is a schematic cross-sectional view of a closed-drift ion source constructed in accordance with yet another specific embodiment of the present invention.

FIG. 12 shows another approximately axisymmetric closed-drift ion source 100 that incorporates a magnetic circuit similar to that of FIG. 9 and, therefore, is an alternate embodiment of the present invention. Except for the use of inner and outer magnetically permeable paths 88 and 90, an effectively single magnetic field source 92, magnetically permeable insert 96, the incorporation of permeable insert 96 into composite anode 102 and annular aperture 104 and adjacent region 106 being in the composite anode that incorporates field-shaping permeable insert 96, the configuration of FIG. 12 is generally similar to the single-stage anode-layer type of closed-drift ion source shown in FIG. 2. The composite anode 102 consists of portions A and B, both at anode potential, where portion A is the permeable insert and portion B is the part within which aperture 104 is located. With the exception of the introduction means for the ionizable gas and with the substitution of annular aperture 104 and adjacent region 106 in FIG. 12 for annular aperture 66 and adjacent region 68 in FIG. 2, the description of operation is also similar.

The introduction arrangement for the ionizable gas in FIG. 12 differs significantly from the prior art. Ionizable gas 46 enters ion source 100 through flow-passage 108 which is at the potential of external magnetically permeable path 90, typically at or near ground potential. The ionizable gas then passes through baffle assembly 110, exit 112 of baffle assembly 110, and is uniformly distributed around the circumference in volume 113, the interior volume of ion source 100 exclusive of region 106. At exit 112 of baffle assembly 110, the pressure of the ionizable gas is below the Paschen-law minimum, and can therefore be exposed to high voltage without electrical breakdown. The Paschen-law minimum for different ionizable gases is in the pressure-distance product range of 1 to 10 Torr-cm. For an electrode spacing of 10 cm, the pressure for minimum breakdown voltage is then 0.1 to 1 Torr, and the breakdown voltage at 0.01 Torr or less is typically 1000 V or more. The ionizable gas then continues to flow in a circumferentially uniform manner through one or more apertures 114 in or adjacent to composite anode 102. As is described later, the dimensions of the parts are such that most of the gas flows through apertures 114, rather than between anode portion B and pole pieces 26 and 28.

The discharge is contained within region 106 by apertures 114 when the apertures are properly constructed. Comparing FIG. 12 with FIG. 9, it can be seen that the ionizable gas must cross magnetic field lines in reaching region 106. These magnetic field lines constitute no restriction to the flow of neutral molecules of the ionizable gas. For the flow of ions and electrons from region 106 back through apertures 114, the presence of the magnetic field directly contains the electrons and, by doing so, generates a space charge to contain the ions. Those skilled in the art of plasma physics will recognize that the strength and extent of the magnetic field in apertures 114 must correspond to at least several electron-cyclotron radii and, to be effective, the direction of the magnetic field must be substantially transverse to the apertures 114.

The use of the introduction assembly for the ionizable gas in FIG. 12 has the advantage of not requiring a voltage isolator in the flow-passage for the ionizable gas. There is the further advantage of exposing the ionizable gas to the anode only after it is at a pressure approaching that in region 112, so that the localized high pressures and corresponding discharge nonuniformities at which U.S. Pat. No. 5,218,271 - Egorov, et al. is directed do not exist.

The advantages of the configuration of FIG. 12 over that of the prior art of FIG. 2 also include the improved operation due to the improved magnetic field that results from the addition of permeable insert 96 and the freedom to move the source or sources of magnetic field far from the region in which most of the discharge energy is dissipated. Further, again with proper selection of the inner and outer radii, relative to the mean radius, an approximately radial direction is obtained for the magnetic field between inner pole piece 26 and outer pole piece 28 (region 40) while using effectively one source of magnetic field.

While the descriptions of the preferred embodiments have used axisymmetric configurations with the accelerated ions moving in a direction generally parallel to the axis of symmetry, other possibilities should be readily apparent. As one example, the configuration can be axially symmetric, but with the ions accelerated in the generally radial direction. As another example, the region in which the gas is ionized and accelerated, instead of being annular in shape, can be of an elongated or "racetrack" shape. Other possibilities of tailoring the configuration to specific needs should be readily apparent.

A specific example is now given of the magnetic-circuit and permeable-insert dimensions that achieve a nearly radial direction for the magnetic field in region 40 of FIG. 12. For a mean radius of 72 mm, the outer radius of inner permeable path 88 is 42 mm, the radius of inner pole piece 26 is 60 mm, the radius of outer pole piece 28 is 84 mm and the inner radius of outer permeable path 90 is 120 mm. Permeable insert 96 (i.e., portion A of composite anode 102) extends from a radius of 60 mm to a radius of 84 mm, has a depth of 24 mm and is spaced 9 mm from pole pieces 26 and 28.

Annular aperture 104 in the anode (portion B) extends from a radius of 66 mm to a radius of 78 mm, has a thickness of 1 mm and is spaced 3 mm from pole pieces 26 and 28. Because the spacing is greater and the passage length shorter between anode portions A and B than between anode portion B and pole pieces 26 and 28, most of the gas flow is between anode portions A and B (i.e., through aperture 114). Using the electrical circuitry described in connection with FIG. 12 with a magnetic field between the pole pieces at a maximum of 180 Gauss at a mean radius of 72 mm, and with the ionizable gas xenon at a flow 2.5 mg/s, an ion beam of 0.85 A has been extracted at a potential difference of 160 V and a discharge current of 4.2 A between cathode 42 and anode 102. The operation at this combination of magnetic field and xenon flow is stable and extends from an anode-cathode potential difference of 60 V to well over 200 V.

As a variation on the operation described above, the positive connection of the power supply can be made only to magnetically permeable insert 96 (i.e., anode portion A), with the portion B of composite anode 102 permitted to electrically "float." The operation is then generally similar to the two-stage anode-layer type of closed-drift ion source shown in FIG. 3. For such an electrical circuit, the ion beam at otherwise similar electrical conditions can be approximately doubled. Other arrangements of electrodes will permit further variations in performance.

While particular embodiments of the present invention have been shown and described, and various alternatives have been suggested, it will be obvious to those of ordinary skill in the art that changes and modifications may be made without departing from the invention in its broadest aspects. Therefore, the aim in the appended claims is to cover all such changes and modifications as fall within the true spirit and scope of that which is patentable.

I claim:

1. A closed-drift ion source for generating an accelerated ion beam comprising:

means defining an approximately annular discharge region into which an ionizable gas is introduced;

an anode located at one longitudinal end of said region;

means enabling the accelerated ion beam to leave from the other longitudinal end of said region;

an electron-emitting cathode near said other end of said region;

a first pole piece located at the radially inward side of said region;

a second pole piece located at the radially outward side of said region to create a generally radial magnetic field located in said region between said pole pieces in response to generation of a magnetic field;

a magnetic circuit composed of permeable elements and consisting essentially of a single magnetic field producing means, said magnetic circuit being generally disposed on said one end of said region with said anode being located between said permeable elements and said region;

and a permeable insert generally disposed on the longitudinal side of said region at which the anode is also situated and physically separated from said elements of said magnetic circuit, said insert shaping said magnetic field in said region so that the magnetic field strength decreases as said anode is approached.

2. A closed-drift ion source as defined in claim 1, further characterized by said anode also being said permeable insert.

3. A closed-drift ion source as defined in claim 1, further characterized by a baffle means in which the ionizable gas is introduced into said ion source, distributed in a uniform circumferential manner around said ion source and decreased in pressure below the Paschen-law minimum before being exposed to anode potential, and then, at said decreased pressure, is introduced to the discharge region through apertures, transverse to which there is sufficient magnetic field to contain the electrons and ions within the discharge region.

4. A closed-drift ion source as defined in claim 3, further characterized by said apertures being in or adjacent to said anode.

5. A closed-drift ion source for generating an accelerated ion beam comprising:

means defining an approximately annular discharge region into which an ionizable gas is introduced;

an anode located at one longitudinal end of said region;

means enabling the accelerated ion beam to leave from the other longitudinal end of said region;

an electron-emitting cathode near said other end of said region;

a first pole piece located at the radially inward side of said region;

a second pole piece located at the radially outward side of said region to create a generally radial magnetic field located in said region between said pole pieces in response to generation of a magnetic field;

a magnetic circuit composed of permeable elements and one or more magnetic field producing means, said magnetic circuit being generally disposed on said one end of said region with said anode being located between elements of said magnetic circuit and said region; and further comprising baffle means through which the ionizable gas is introduced into said ion source, distributed in a uniform circumferential manner around said ion source and decreased in pressure below the Paschen-law minimum before being exposed to anode potential, and then, at said decreased pressure, is introduced to the discharge region through apertures, transverse to which there is sufficient magnetic field to contain the electrons and ions within the discharge region.

6. A method for introducing an ionizable gas into a closed-drift ion source for generating an accelerated ion beam of the type including:

means defining an approximately annular discharge region into which an ionizable gas is introduced;

a volume that is the interior volume of said closed drift ion source and exclusive of said region;

an anode located at one longitudinal end of said region;

means enabling the accelerated ion beam to leave from the other longitudinal end of said region;

an electron-emitting cathode near said other end of said region;

a first pole piece located at the radially inward side of said region;

a second pole piece located at the radially outward side of said region to create a generally radial magnetic field located in said region between said pole pieces in response to generation of a magnetic field;

a magnetic circuit composed of permeable elements and one or more magnetic field producing means, said magnetic circuit being generally disposed on said one end of said region with said anode being located between elements of said magnetic circuit and said region;

wherein the method comprises the steps of:

a. providing a baffle means disposed on the side of the anode opposite said region, having an inlet passage, at least one circumferential passage and at least one exit aperture generally facing said anode;

b. passing the ionizable gas through said baffle means, with said ionizable gas having a pressure above the Paschen-law minimum at said inlet and being distributed in a uniform circumferential manner in said volume at a pressure below the Paschen-law minimum after passing through said exit aperture.

7. A method in accordance with claim 6 comprising the further steps of:

a. providing apertures in or adjacent to the anode wherein the magnetic field transverse to said apertures is sufficiently strong to contain the electrons and ions within said discharge region;

b. passing the ionizable gas from the side of the anode disposed opposite to that of the said region, through the apertures, and to said region with the pressure of the gas throughout maintained below the Paschen-law minimum.

8. A method in accordance with claim 6, wherein said baffle means is positioned within said ion source.

9. In a closed drift ion source means for generating an accelerated ion beam including, means defining an approximately annular discharge region into which an ionizable gas is introduced;

an anode located at one longitudinal end of said region;

means enabling the accelerated ion beam to leave from the other longitudinal end of said region;

an electron-emitting cathode near said other end of said region;

a first pole piece located at the radially inward side of said region;

a second pole piece located at the radially outward side of said region to create a magnetic field located in said region between said pole pieces in response to generation of a magnetic field;

a magnetic circuit composed of permeable elements and magnetic field producing means, said magnetic circuit being generally disposed on said one end of said region with said anode being located between said permeable elements and said region;

and a permeable insert generally disposed on the longitudinal side of said region at which the anode is also situated and physically separated from said elements of said magnetic circuit;

wherein the improvement comprises:

said permeable elements of said magnetic circuit and said permeable insert being shaped so as to provide said magnetic field in a generally radial direction and with a decreasing strength as said anode is approached and said magnetic field producing means is essentially a single magnetic field producing means.

10. A closed-drift ion source as defined in claim 9, further characterized by said essentially single magnetic field producing means being located far from said region.

* * * * *